US006058892A

United States Patent [19]

Haack, II

[11] Patent Number: 6,058,892

[45] Date of Patent: May 9, 2000

[54] SAFETY AIR FLOW CONTROL AND ROUTING APPARATUS FOR A WATER HEATER, WATER HEATER INCORPORATING THE APPARATUS, AND METHOD OF USING SAME

[76] Inventor: Roger I. Haack, II, 8083 Flintlock Rd., Mt. Morris, Mich. 48458

[21] Appl. No.: 09/137,810

[22] Filed: Aug. 26, 1998

[51] Int. Cl.[7] ..... F22B 37/42

[52] U.S. Cl. ..... 122/504; 122/13.1; 122/14; 122/17; 126/350 R; 126/361

[58] Field of Search ..... 122/13.1, 14, 17, 122/504; 126/350 R, 361, 363

[56] References Cited

U.S. PATENT DOCUMENTS

| | | | |
|---|---|---|---|
| 4,856,982 | 8/1989 | Olson . | |
| 4,867,106 | 9/1989 | Staats . | |
| 4,940,042 | 7/1990 | Moore . | |
| 5,085,205 | 2/1992 | Hall et al. | 126/363 |
| 5,199,385 | 4/1993 | Doss . | |
| 5,555,997 | 9/1996 | Nogles | 126/350 R |
| 5,636,598 | 6/1997 | Moore . | |
| 5,765,547 | 6/1998 | La Plante | 126/361 |
| 5,797,355 | 8/1998 | Bourke et al. | 122/17 |
| 5,848,586 | 12/1998 | Garms | 126/361 |

*Primary Examiner*—Mark Paschall
*Assistant Examiner*—Jiping Lu
*Attorney, Agent, or Firm*—Carrier, Blackman & Associates, P.C.; William D. Blackman; Joseph P. Carrier

[57] ABSTRACT

An air flow control and routing apparatus for attaching to a water heater, to restrict entry of floor-level gases into the water heater, includes a substantially annular skirt for surrounding a base portion of a water heater. Preferably, the skirt has a closable pilot access door formed therein. The apparatus also includes at least one air intake tube attached to the annular skirt for transporting inlet air therethrough, the air intake tube having an elevated inlet, relative to the skirt, when the apparatus is in an installed orientation thereof. In this first embodiment of the invention, the apparatus is constructed and arranged to feed indoor air, from a portion of a room above floor level, to a water heater combustion chamber, located at the lower end of a water heater, when installed thereon. The invention also encompasses a water heater having the air flow control and routing apparatus installed thereon, and a method of routing inlet air into a water heater using the described apparatus.

13 Claims, 2 Drawing Sheets

FIG 4
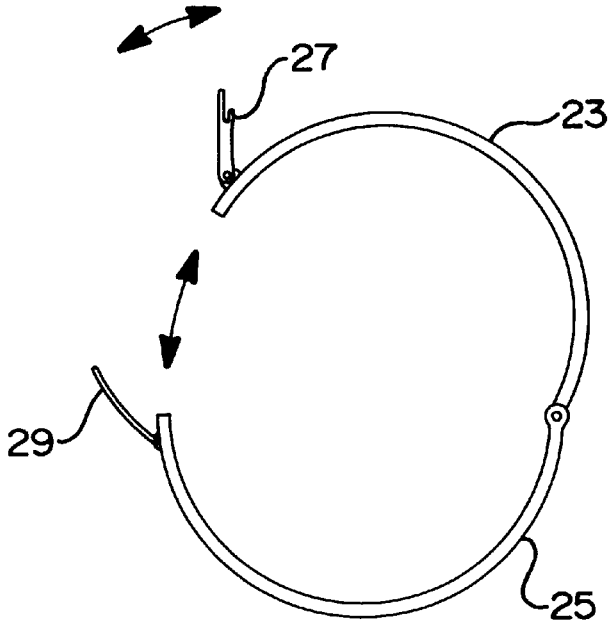
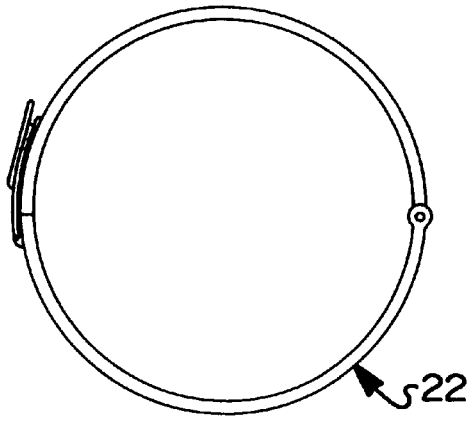
FIG 5

SAFETY AIR FLOW CONTROL AND ROUTING APPARATUS FOR A WATER HEATER, WATER HEATER INCORPORATING THE APPARATUS, AND METHOD OF USING SAME

BACKGROUND OF THE INVENTION

1. Field of the Invention

The present invention relates to an apparatus for attaching to a water heater and for use in conjunction therewith, to restrict and/or impede entry of floor-level gases into the water heater. More particularly, the present invention relates to a safety apparatus for adding on to an existing water heater, or for incorporating into a new water heater, to force incoming air, for combustion, to enter at a level elevated above the floor. The apparatus according to the invention, when properly installed on a water heater, significantly reduces the likelihood that flammable fumes from a volatile liquid, if spilled near a water heater, will be ignited by flames inside of the water heater.

2. Description of the Background Art

Many different types of water heaters are known and commercially available. Some examples of known designs for water heaters can be found in the disclosures of U.S. Pat. Nos. 4,856,982, 4,867,106, 4,940,042, 5,199,385, and 5,636,598.

In the design of the water heater disclosed in U.S. Pat. No. 4,940,042 to Moore, Jr. et al., a specialized conduit assembly extends from a water heater body, through a building wall, and ends outside of a building which houses the water heater. The conduit assembly of the Moore, Jr. '042 reference contains separate passages for incoming combustion air and outgoing exhaust gases. The conduit assembly acts to completely separate both incoming combustion air, and outgoing exhaust gases, from ambient room air inside the building where the water heater is situated. In the design of this reference, the water heater combustion chamber is sealed off from ambient room air around the water heater, and any fresh intake air, coming in to the combustion chamber, must be routed in from outdoors.

Most conventional gas-fired water heaters have a combustion chamber located near the floor of a base portion or body thereof, and also have an air inlet located adjacent the combustion chamber and very near the floor, to provide a source of fresh air to the combustion chamber. This type of design is logical because of the natural effect of flame, and heat thereof, to rise upwardly, and a tank for holding water to be heated may be conveniently located above a burner located at the floor of the water heater. The air inlet is normally located near the combustion chamber burner for simplicity of construction, and this is a good overall design for normal circumstances.

However, in some circumstances, flammable fluids such as gasoline, dry cleaning fluids, kerosene or paint thinner may be used in a basement, back room or shop area where a gas-fired water heater is located. If any significant accumulation of fumes, from these types of flammable liquids, builds up in a room, the fumes generally tend to collect, and mostly remain near the floor of a room, rather than becoming dispersed evenly throughout the room from top to bottom. Such collection of fumes near the floor takes place because fumes of this type are generally heavier than air, and where such an accumulation occurs, this may create a fire hazard.

Sometimes, a person working in such an area may accidentally drop one or more rags, which contain a flammable liquid, on the floor near the combustion air intake of a water heater. Furthermore, while never done intentionally, it is also possible that a flammable fluid may be accidentally and inadvertently spilled on a floor of a room where a gas-fired water heater is located.

In the unfortunate event that either flammable rags are left near an air intake for a water heater, or that this type of spillage takes place, it is further possible that fumes from the flammable liquid, or even some of the flammable liquid itself, may find its way into the combustion chamber of a water heater having its combustion air inlet located at floor level. It is then conceivable that flame inside the water heater could ignite those flammable fumes, and such a flame could then propagate and spread outwardly from the water heater, following the flammable liquid or the fumes thereof, and could start rags, liquid fuel, or other items which are situated near the water heater, on fire. If left unchecked or unnoticed, this type of fire could spread and cause further damage.

It is further possible that a fire caused by this type of accident could cause extensive damage and loss of property, or could even lead to loss of life in a worst-case scenario.

Accordingly, a need exists in the art for a water heater design, or for a safety apparatus which may be added to an existing water heater, that will effectively restrict and/or impede incoming combustion air from entering at floor level, and instead, will route incoming ambient room air to the combustion chamber from an area above floor level.

SUMMARY OF THE INVENTION

In a first embodiment, the present invention provides a safety air flow control and routing apparatus for attaching to a water heater, to restrict and/or impede entry of floor-level gases into the water heater.

An apparatus in accordance with the first embodiment of the invention, generally, includes a substantially annular skirt for surrounding a base portion of a water heater. The apparatus also includes at least one air intake tube attached to the annular skirt for transporting inlet air therethrough, the air intake tube extending upwardly from the skirt and having an elevated inlet, relative to the skirt, when the apparatus is in an installed orientation thereof. In this first embodiment of the invention, the apparatus is constructed and arranged to route indoor air, from a portion of a room above floor level, to a combustion chamber of a water heater, when installed thereon. Optionally, the skirt may have a closable pilot access door formed therein.

Accordingly, it is an object of the present invention to provide a method and apparatus for restricting inlet air, coming into a water heater, from entering at floor level, and instead, to route incoming air to the water heater from a level elevated significantly above the floor.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 4 is a top plan view of the apparatus of FIG. 1, shown in an opened configuration thereof, with the air inlet tube(s) omitted for purposes of illustration; and FIG. 5 is a top plan view of the apparatus of FIG. 1, shown in a closed and latched configuration thereof, with the air inlet tube(s) omitted for purposes of illustration.

DETAILED DESCRIPTION OF THE PREFERRED EMBODIMENT

Figure 1:
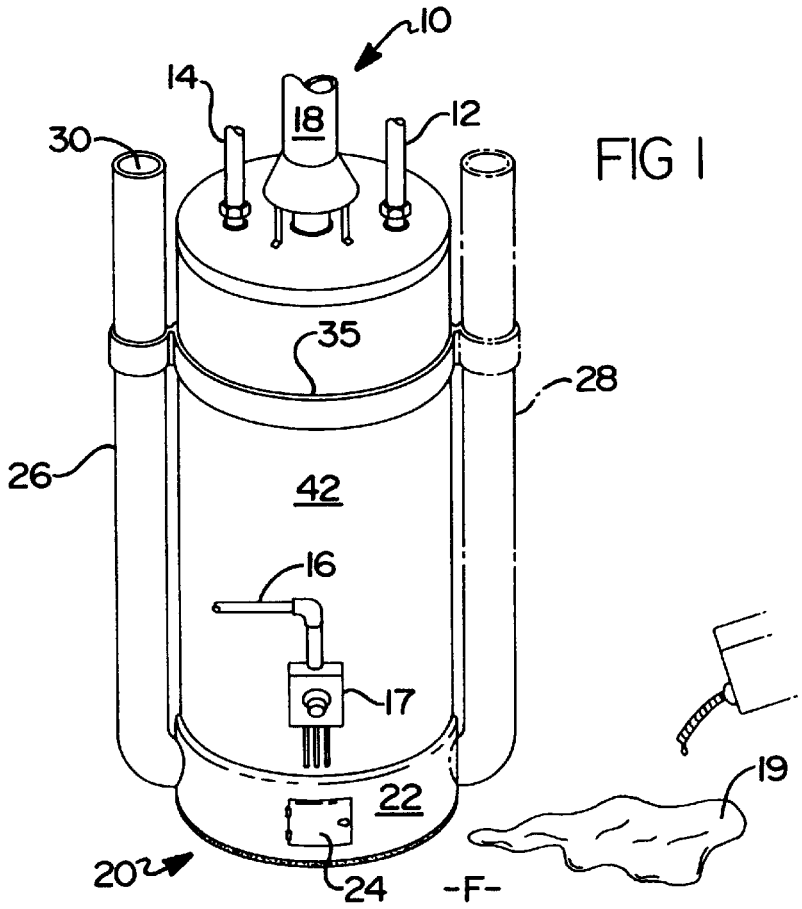
FIG. 1 is a perspective view, partially cut away, of a water heater and associated piping, with an apparatus according to the present invention installed thereon, showing an optional second intake tube in phantom, and also showing a flammable liquid spill.

Referring now to the drawings, a gas-fired water heater is shown at 10, with a safety air flow control and routing apparatus 20, in accordance with a first embodiment of the present invention, installed thereon. The apparatus 20 according to the present invention is designed to restrict and/or impede the entry of floor-level combustion air into the water heater 10, so that air can only enter the water heater at an area which is elevated above the floor F of the room where the water heater is located. In the practice of the present invention, however, the water heater 10 still uses ambient indoor air, from the room where the water heater is situated, for supporting combustion.

The practice of the present invention advantageously avoids any necessity for forming holes through residential walls, and for special ductwork which passes through holes formed in residential walls, by using indoor air for combustion in the water heater. In addition, the simplicity of the design of the apparatus 20 according to the invention lends itself to manufacture at a cost which is reasonably affordable to homeowners and commercial users.

Many features of the water heater 10 are conventional. It is provided with a water inlet 12, a water outlet 14, a flammable gas inlet pipe 16, a thermostatic control valve 17, and an exhaust gas duct pipe 18 in conventional fashion.

Overview of the Safety Air Flow Control and Routing Apparatus

In order to reduce health and safety risks from the possibility of lighting fumes from the accidental spillage of a flammable fluid 19, in the practice of the present invention, the safety air flow control and routing apparatus 20 is added to the bottom of the water heater 10.

The safety air flow control and routing apparatus 20, according to the invention, may be incorporated into the water heater 10 as an original equipment component thereof, or alternatively, the flow control apparatus 20 may be provided as an add-on retrofit item for installation on an existing water heater 10.

The safety air flow control and routing apparatus 20 may be formed primarily from sheet metal, such as thin sheet steel or aluminum, or may be made from a durable and heat-resistant plastic. The apparatus 20 includes a substantially annular skirt 22 which is sealed at the top and bottom thereof, and at least one air intake tube 26 attached to the skirt 22 to feed air into the water heater 10. Each of these component pieces will be discussed in further detail below.

The Skirt

As previously noted, the safety air flow control and routing apparatus 20 includes a substantially annular skirt 22 for encircling and surrounding a base portion of a water heater 10. Suitable modifications may be made to the generally annular shape of the skirt 22, where needed, to accommodate hardware running along the outside surface of the water heater 10 such as, e.g., a drain pipe for a pressure relief valve, the gas inlet pipe 16, etc.

Figure 3:
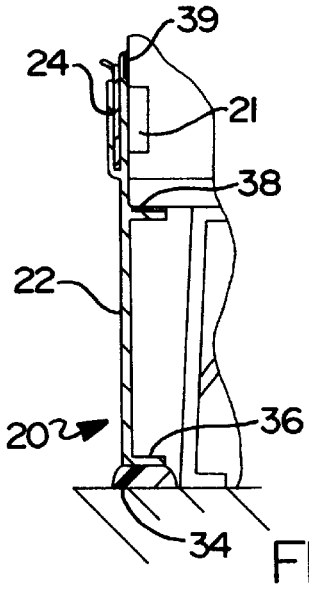
FIG. 3 is a cross-sectional detail view, partially cut away, of the water heater and apparatus of FIGS. 1–2, taken along a vertical plane which is substantially transverse to the plane of FIG. 2.

Preferably, the skirt 22 has a closable pilot access door 24 formed therein to allow a user to gain access to a conventional pilot light and related controls (not shown) when such access is needed. The access door 24 may be attached to the skirt with a hinge, or may be slidably attached to the skirt between tracks provided therein. Preferably, the pilot access door 24 also has one or more seals attached thereto on the inside peripheral edge thereof, to restrict air flow therepast. The pilot access door 24 of the skirt 22 may open on to a conventional pilot access door 21 (FIG. 3) built into the side of the water heater 10.

In a preferred embodiment of the present invention, the safety air flow control and routing apparatus 20 is formed from a durable, heat-resistant plastic material, the pilot access door 24 is integrally formed with the skirt 22, and the connection between the skirt and access door is a 'living hinge' made of plastic material. A latch may also be provided where the access door 24 is hingedly attached to the skirt 22.

The skirt 22 is provided with a first annular sealing member 34 (FIG. 2) at a lower end 36 thereof, to form a first substantially air-tight seal between the bottom of the skirt 22 and the floor F. Preferably, the first annular sealing member 34 is flexibly adaptable so as to be able to form a seal against a floor surface which is not perfectly flat, as may be found in some basements. The first annular sealing member 34 may, accordingly, be made of a flexible foam material to take up some irregularity in the surface of the floor F.

Moreover, the skirt 22 is also, preferably, provided with a second annular sealing member 38 at an upper end 40 thereof, to form a second substantially air-tight seal between the top of the skirt 22 and the water heater body 42. Although the second annular sealing member 38 is shown in a substantially horizontal cross-sectional orientation thereof, it could just as well be vertically oriented in cross-section, as shown by the vertical seal 39, so long as it forms a substantial seal between the skirt and the water heater body 42. If desired, both horizontal and vertical second sealing members 38, 39 may be used to provide extra sealing protection.

In the practice of the present invention, it is not necessary for the sealing members 34, 38, 39 to form perfect seals and to exclude all air passage therepast, for the invention to work. Rather, as long as most air around the skirt 22 is kept from getting past the sealing members 34, 38, 39, and most of the combustion air used is brought in from an area substantially above floor level, through the air inlet tube or tubes 26, 28, the danger of a flame spreading outwardly from the combustion chamber, to ignite rags or spilled flammable liquids, is low. It is preferred, however, to obtain the best seal practicable, and to use materials which provide seals that are substantially complete.

Referring now to FIGS. 4 and 5, it may be seen that in one embodiment of the invention, the skirt 22 may be made in two pivotally connected sections. The sections of the skirt 22 include a first half shell 23 and a second half shell 25 which is pivotally attached to the first half shell 23. The first half shell 23, in this embodiment, has a first latching member 27 pivotally attached thereto, for cooperating with a second latching member 29 which is pivotally attached to the second half shell 25. The first and second latching members 27, 29 may be connected and latched together to temporarily and disengagably lock the skirt 22 into a closed configuration thereof, as shown in FIG. 5. The skirt 22 may be latched in place at the bottom of a water heater body 42, in an orientation substantially as shown in FIG. 1.

The Air Intake Tube(s)

The apparatus 20 also includes at least one air intake tube 26 which is sealably attached to the annular skirt 22 for transporting inlet air therethrough. The air intake tube 26 is formed from the same material as the skirt 22. In the embodiment of FIG. 1, a first air intake tube 26 is shown in solid lines and a second, optional air intake tube 28 is shown in phantom. The air intake tube 26 has an elevated inlet 30, relative to the floor F and to the skirt 22, when the apparatus is in an installed orientation thereof, as shown. As may be seen from the drawings, the intake tube 26 completely surrounds and defines an air flow channel therein in the hollow passage 32, for routing intake air downwardly therethrough, in the direction of the arrow in FIG. 2.

It is preferred, in the practice of the present invention, that the intake 30 be located at least three feet above the floor F, or halfway up the water heater body 42, whichever is greater. Most preferably, the inlet 30 of the air intake tube 26 is located at a height which is at least as high as, or higher than the top of the water heater body 42.

In this first embodiment of the invention, the apparatus 20 is constructed and arranged to route indoor air, from a portion of a room above floor level, to the combustion chamber C of the water heater 10, when installed thereon.

Figure 2:
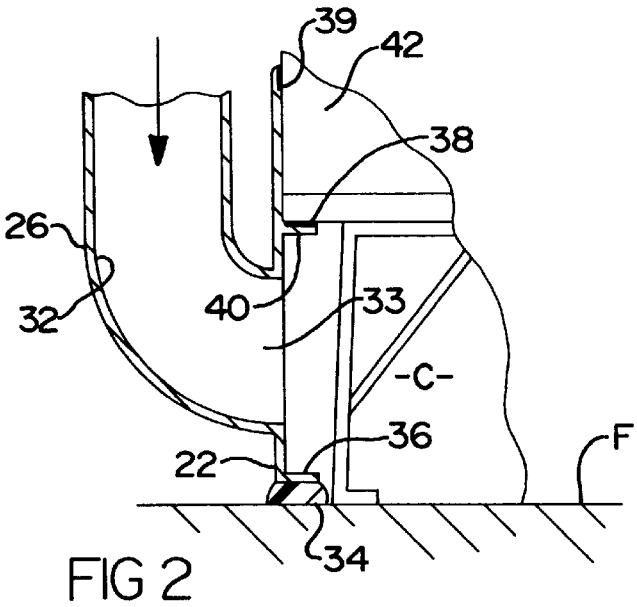
FIG. 2 is a cross-sectional detail view, partially cut away, of the water heater and apparatus of FIG. 1, taken along a vertical plane which passes through an intake tube thereof.

Referring once again to FIG. 2, it may be seen that the air intake tube 26 defines a hollow passage 32 therein, and this passage feeds incoming combustion air downwardly, as shown by the arrow in the drawing, through a first connecting aperture 33 in the skirt 22, and into a combustion chamber C of the water heater 10. At the point where the air intake tube 26 connects to the skirt 22, the first connecting aperture 33 is formed in the skirt 22 to allow fluid communication between the hollow passage 32 and the space inside the skirt 22. It is preferred that the intake tube 26 be sealably attached to the skirt 22 so that no air may pass into the skirt from outside of the apparatus 20, unless it comes through the air intake tube or tubes 26, 28, as the case may be.

Where used, for high-flow applications, the second air intake tube 28 is a mirror image of, and is otherwise substantially identical to, the first air intake tube 26, as herein described. Accordingly, it will be understood that where the second intake tube 28 is used, a second connecting aperture is provided in the skirt 22, which is similar to the first connecting aperture 33 as shown in FIG. 2.

Optionally, and as shown in FIG. 1, a surrounding support band 35 may be provided for placement between and surrounding the air intake tube(s) and the water heater body 42 to interconnect, reinforce and support the air intake tube(s) against the water heater body. Where used, the support band 35 may be made of metal or of plastic.

Method of Use

When the apparatus 20 hereof is properly installed on a water heater 10, it operates to restrict and/or impede air from entering the combustion chamber at floor level, and instead, the apparatus 20 routes such air exclusively from an above-floor level of the room where the elevated intake is located.

A method of using the apparatus 20, generally, may, optionally, include a first step of installing the safety air flow control and routing apparatus 20 hereof on a water heater 10. Once installed on a water heater, the method of using the safety air flow control and routing apparatus 20 includes the steps of allowing room air to enter the combustion chamber from an elevated intake which is above floor level, while substantially preventing room air from directly entering the water heater combustion chamber C from outside the apparatus at floor level, and routing the air downwardly through the air inlet tube and into the combustion chamber C.

Benefits of the Apparatus

When the apparatus 20 according to the present invention is properly installed on a water heater 10, even in the unfortunate event that a flammable fluid 19 is accidentally spilled on a floor F of a room where the hot water heater is situated, fumes from the flammable fluid will tend to collect at a low level in the room, and will not significantly be able to enter the elevated intake 30 of the air intake tube 26. Even if some fumes do enter the elevated intake 30 and travel as far as the combustion chamber C, the fumes would be likely to become highly diluted with air in the course of being forced to travel upwardly to the elevated intake 30, and then downwardly through the air intake tube 26 to the combustion chamber C. As a result, it is highly unlikely that a flame front would be able to travel back up the intake tube 26 and outwardly therefrom into a room. Therefore, the method and apparatus 20 according to the present invention, where used, provide an increased degree of protection from risk of fire caused by the above-described type of spillage.

Where this type of spillage does occur in proximity to a water heater 10 equipped with the apparatus 20 according to the preferred embodiment of the invention, the use of the method and apparatus 20 according to the present invention will provide extra time for an operator to discover any spillage, to begin cleanup efforts, and to shut off the flow of gas to the water heater 10, if necessary, without being in danger of imminent fire.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

I claim:

1. An air flow control and routing apparatus for attaching to a water heater to restrict entry of floor-level gases into said water heater, said apparatus comprising:

a substantially annular skirt for surrounding a base portion of a water heater, said skirt comprising a substantially cylindrical skirt body having openings formed in the top and bottom thereof, said skirt body comprising two separably disengagable sections;

a first sealing member disposed proximate the bottom of said skirt for restricting air flow past therepast;

second sealing member disposed proximate the top of said skirt for restricting air flow therepast; and at least one air intake tube attached to said skirt for transporting inlet air therethrough, said air intake tube having an inlet formed therein which is elevated above the top of said skirt;

wherein said apparatus is constructed and arranged to feed indoor air, from a portion of a room above floor level, to a water heater when installed thereon.

2. The apparatus of claim 1, wherein said first sealing member is made of a flexible foam material.

3. The apparatus of claim 1, further comprising a closable pilot access door formed in said skirt.

4. The apparatus of claim 1, wherein said skirt body comprises a first half shell and a second half shell which is pivotally attached to the first half shell.

5. The apparatus of claim 4, further comprising a first latching member attached to said first shell, and a second latching member attached to said second shell, wherein said first and second latching members are cooperatively engagable to temporarily and disengagably lock the skirt into a closed configuration thereof.

6. The apparatus of claim 1, further comprising a reinforcing support member for placement between said air intake tube and a water heater body to interconnect, reinforce and support said air intake tube against the water heater body;

said reinforcing support member comprising a first support section for attaching to a water heater body, and a second support section for supporting the air intake tube.

7. The apparatus of claim 1, wherein a pair of air inlet tubes are attached to said skirt, and each of said air inlet tubes is in fluid communication with said skirt.

8. The apparatus of claim 1, wherein the apparatus is formed from a heat-resistant plastic.

9. The apparatus of claim 8, wherein the skirt has a pilot access door formed therein, the pilot access door being attached to the skirt body by a living hinge.

10. The apparatus of claim 1, wherein the skirt has a connecting aperture formed therein, and the air inlet tube is sealingly connected to the skirt at the connecting aperture for fluid communication therethrough.

11. A water heater assembly, comprising:

a water heater having a generally cylindrical body;

an air flow control and routing apparatus attached to said water heater to restrict entry of floor-level gases thereinto, said apparatus comprising:

a substantially annular skirt surrounding a base portion of said water heater, said skirt comprising a substantially cylindrical skirt body having openings formed in the top and bottom thereof, said skirt body comprising two separably disengagable sections; and at least one air intake tube attached to said annular skirt for transporting inlet air therethrough, said air intake tube having an inlet elevated above the top of said skirt;

a first sealing member disposed proximate the bottom of said skirt for sealingly abutting against a floor surface and for restricting air flow therepast; and a second sealing member interposed between the top of said skirt and said water heater body.

12. A method of modifying a gas-fired water heater to route inlet air flow into a combustion chamber thereof, comprising the steps of:

providing an air flow control apparatus comprising;

a substantially annular skirt comprising a substantially cylindrical skirt body having openings formed in the top and bottom thereof; and at least one air intake tube attached to said annular skirt for transporting inlet air therethrough, said air intake tube having an inlet elevated above the top said skirt;

a first sealing member disposed proximate the bottom of said skirt for restricting air flow therepast; and a second sealing member disposed proximate the top of said skirt;

attaching said air flow control apparatus to a cylindrical water heater body by pivotally separating two halves of said skirt body, closing said skirt around said cylindrical water heater body, and fastening the two halves of said skirt body together, such that the second sealing member at the top portion of said skirt substantially forms a seal against said water heater body and said first sealing member substantially forms a seal against a floor surface;

allowing room air to enter said flow control apparatus through an elevated intake which is above floor level, while substantially preventing room air from entering the water heater from an area at floor level; and routing the air downwardly through said air inlet tube of said flow control apparatus and into the combustion chamber.

13. The method of claim 12, wherein said elevated inlet is located at a height at least halfway up a body portion of the water heater.

* * * * *